US011633008B2

(12) United States Patent
Iuchi et al.

(10) Patent No.: US 11,633,008 B2
(45) Date of Patent: Apr. 25, 2023

(54) SHOE

(71) Applicant: Shimano Inc., Osaka (JP)

(72) Inventors: Kadunori Iuchi, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 17/443,698

(22) Filed: Jul. 27, 2021

(65) Prior Publication Data

US 2023/0032704 A1 Feb. 2, 2023

(51) Int. Cl.
*A43B 13/14* (2006.01)

(52) U.S. Cl.
CPC ..... *A43B 13/14* (2013.01)

(58) Field of Classification Search
CPC ..... A43B 13/023; A43B 13/12; A43B 13/125; A43B 13/127; A43B 13/14
See application file for complete search history.

(56) References Cited

U.S. PATENT DOCUMENTS 5,515,622 A 5/1996 Lee
5,937,544 A * 8/1999 Russell ..... A43B 7/1435 36/27
6,327,795 B1 * 12/2001 Russell ..... A43B 13/12 36/27
6,330,757 B1 * 12/2001 Russell ..... A43B 13/185 36/27
6,502,330 B1 1/2003 David et al.
6,675,502 B1 * 1/2004 Chen ..... A43B 13/187 36/28
7,818,897 B2 10/2010 Geer
10,342,285 B2 7/2019 Aoki et al.
10,709,203 B2 * 7/2020 Granger ..... A43B 17/18
2002/0157280 A1 * 10/2002 Russell ..... A43B 13/185 36/28
2004/0123493 A1 * 7/2004 Russell ..... A43B 13/181 36/114
2004/0134095 A1 * 7/2004 Bray, Jr. ..... A43B 13/42 36/9 R
2008/0289215 A1 11/2008 Park
2008/0313924 A1 * 12/2008 Righetto ..... A43B 7/1445 36/43

(Continued)

FOREIGN PATENT DOCUMENTS

EP 0 913 101 A2 5/1999
WO 90/01275 A1 2/1990

*Primary Examiner* — Bao-Thieu L Nguyen
(74) *Attorney, Agent, or Firm* — Global IP Counselors, LLP

(57) ABSTRACT

A shoe basically includes an upper and a sole. The sole is attached to the upper. The sole includes an outsole and a first midsole. The first midsole has a fore part, a first heel part, a second heel part and a boundary part. The first heel part is at least partly disposed along a longitudinal centerline of the shoe and configured to support a center part of a heel. The second heel part is disposed laterally outward of the longitudinal centerline of the shoe and configured to support an outer part of the heel. The boundary part is provided between the first heel part and the second heel part such that the first heel part and the second heel part are movable relative to one another.

16 Claims, 10 Drawing Sheets

(56) References Cited

U.S. PATENT DOCUMENTS

| | | | | |
|---|---|---|---|---|
| 2009/0019730 | A1* | 1/2009 | Salminen | A43B 7/1425<br>36/102 |
| 2015/0351494 | A1* | 12/2015 | Jung | A43B 13/20<br>36/44 |
| 2018/0255867 | A1 | 9/2018 | Cornett | |
| 2020/0305541 | A1* | 10/2020 | Yahata | A43B 13/12 |
| 2022/0039510 | A1* | 2/2022 | Winefordner | A43B 13/14 |
| 2022/0087359 | A1* | 3/2022 | Sakamoto | A43B 7/087 |

* cited by examiner

SHOE

BACKGROUND

Technical Field

This disclosure generally relates to a shoe. More specifically, the present disclosure relates to a shoe provided with the shoe sole.

Background Information

Recently, shoes have become very specialized for a particular activity. As a result, some shoes may be good for some activities while unsuitable for other activities. For example, traditional cycling shoes are suitable for riding, but not very suitable for walking. In particular, traditional cycling shoes have rigid or highly stiffness soles for transmitting a pedaling force to a pedal. On the other hand, rigid or highly stiffness soles are not suit for walking, because the sole cannot absorb the shock when the shoe contact on the ground. Also, some cycling shoes are provided with a cleat attachment for attaching a cleat. For example, a cycling shoe is disclosed in U.S. Pat. No. 10,342,285, which is assigned to Shimano Inc.

SUMMARY

In developing the shoe of the present disclosure, it has been discovered that the load point of action for riding is different than for walking.

Generally, the present disclosure is directed to various features of a shoe that can be used for different activities such as riding a human-powered vehicle and walking.

In view of the state of the known technology and in accordance with a first aspect of the present disclosure, a shoe is provided that basically comprises an upper and a sole. The sole is attached to the upper. The sole includes an outsole and a first midsole. The first midsole has a fore part, a first heel part, a second heel part and a boundary part. The first heel part is at least partly disposed along a longitudinal centerline of the shoe and configured to support a center part of a heel. The second heel part is disposed laterally outward of the longitudinal centerline of the shoe and configured to support an outer part of the heel. The boundary part is provided between the first heel part and the second heel part such that the first heel part and the second heel part are movable relative to one another.

With the shoe according to the first aspect, it is possible to provide a shoe that is suitable different activities such as riding a human-powered vehicle and walking.

In accordance with a second aspect of the present disclosure, the shoe according to the first aspect is configured so that the boundary part includes at least one opening disposed between the first heel part and the second heel part.

With the shoe according to the second aspect, the second heel part can deform independently of the first heel part so that the first heel part can transmit a pedaling force to a pedal and the second heel part absorb the contact force during walking.

In accordance with a third aspect of the present disclosure, the shoe according to the first aspect or the second aspect is configured so that the boundary part includes a slit disposed between the first heel part and the second heel part.

With the shoe according to the third aspect, it is possible to reliably provide independent deformation of the second heel part relative to the first heel part during walking.

In accordance with a fourth aspect of the present disclosure, the shoe according to any one of the first aspect to the third aspect is configured so that the boundary part has a lower rigidity than the first heel part and the second heel part.

With the shoe according to the fourth aspect, the second heel part can reliably deform relative to the first heel part the during walking due to the lower rigidity of the boundary part relative to the first heel part and the second heel part.

In accordance with a fifth aspect of the present disclosure, the shoe according to the third aspect or the to the fifth aspect is configured so that the slit has a first end positioned on an outer lateral side of the first midsole with respect to the longitudinal centerline and a second end positioned on an inner lateral side of the first midsole with respect to the longitudinal centerline. The second end of the slit is positioned rearward of the first end or laterally aligned with respect to the longitudinal centerline.

With the shoe according to the fifth aspect, the outer lateral side of the first midsole can reliably deform during walking.

In accordance with a sixth aspect of the present disclosure, the shoe according to any one of the first aspect to the fifth aspect is configured so that the second heel part includes an inside heel part and an outside heel part. The boundary part includes an inside boundary part and an outside boundary part. The inside boundary part is positioned between the inside heel part and the first heel part. The outside boundary part is positioned between the outside heel part and the first heel part.

With the shoe according to the sixth aspect, the inside heel part and the outside heel part of the second heel part can reliably deform relative to the boundary part during walking.

In accordance with a seventh aspect of the present disclosure, the shoe according to any one of the first aspect to the sixth aspect further comprises a second midsole at least disposed beneath the first heel part of the first midsole. The second midsole has a receiving portion configured to receive at least a portion the first heel part upon relative movement of the first heel part towards the outsole.

With the shoe according to the seventh aspect, downward deformation of the first heel part can be reliably realized.

In accordance with an eighth aspect of the present disclosure, the shoe according to the seventh aspect is configured so that the receiving portion includes a hollow depression.

With the shoe according to the eighth aspect, downward deformation of the first heel part into the hollow depression can be easily achieved.

In accordance with a ninth aspect of the present disclosure, the shoe according to the seventh aspect or the eighth aspect is configured so that the receiving portion includes a plurality of slits.

With the shoe according to the ninth aspect, the amount of downward deformation of the first heel part can be easily regulated based on the number an/or size of the slits.

In accordance with a tenth aspect of the present disclosure, the shoe according to any one of the seventh aspect to the ninth aspect is configured so that the receiving portion includes a foam material having a hardness that is lower than a surrounding portion of the second midsole that at least partly surrounds the receiving portion.

With the shoe according to the tenth aspect, the amount of downward deformation of the first heel part can be easily regulated based on the hardness of the foam material that is used.

In accordance with an eleventh aspect of the present disclosure, a shoe is provided that basically comprises an upper and a sole. The sole is attached to the upper. The sole includes an outsole and a first midsole. The first midsole at least overlies from a mid part of the outsole to a heel part of the outsole. The first midsole has a fore part, a first heel part and a second heel part. The first heel part is connected to the fore part. The second heel part is connected to the fore part. The first heel part is more rigid than the second heel part.

With the shoe according to the eleventh aspect, it is possible to provide a shoe that is suitable different activities such as riding a human-powered vehicle and walking.

In accordance with a twelfth aspect of the present disclosure, the shoe according to the eleventh aspect further comprises a second midsole at least disposed beneath the first heel part of the first midsole. The second midsole has a receiving portion configured to receive at least a portion the first heel part upon relative movement of the first heel part towards the outsole.

With the shoe according to the twelfth aspect, downward deformation of the first heel part can be reliably realized.

In accordance with a thirteenth aspect of the present disclosure, the shoe according to the twelfth aspect is configured so that the receiving portion includes a hollow depression.

With the shoe according to the thirteenth aspect, downward deformation of the first heel part into the hollow depression can be easily achieved.

In accordance with a fourteenth aspect of the present disclosure, the shoe according to any one of the twelfth aspect to the thirteenth aspect is configured so that the receiving portion includes a plurality of slits.

With the shoe according to the fourteenth aspect, the amount of downward deformation of the first heel part can be easily regulated based on the number and/or size of the slits.

In accordance with a fifteenth aspect of the present disclosure, the shoe according to any one of the twelfth aspect to the fourteenth aspect is configured so that the receiving portion includes a foam material having a hardness that is lower than a surrounding portion of the second midsole that at least partly surrounds the receiving portion.

With the shoe according to the fifteenth aspect, the amount of downward deformation of the first heel part can be easily regulated based on the hardness of the foam material that is used.

Also, other objects, features, aspects and advantages of the disclosed shoe will become apparent to those skilled in the art from the following detailed description, which, taken in conjunction with the annexed drawings, discloses preferred embodiments of the shoe.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the shoe field from this disclosure that the following descriptions of the embodiments are provided for illustration only and not for the purpose of limiting the invention as defined by the appended claims and their equivalents.

Figure 1:
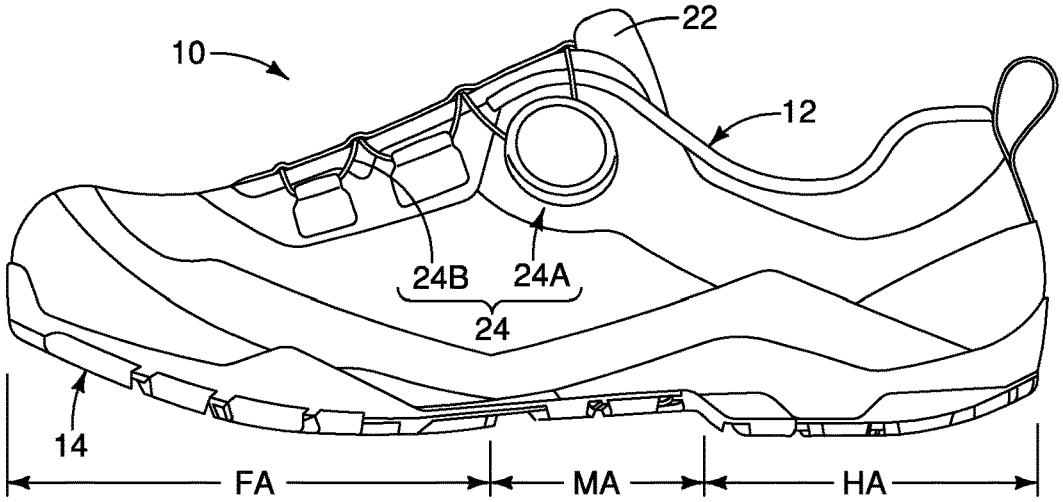
FIG. 1 is a side elevational view of a shoe in accordance with one embodiment.
Figure 2:
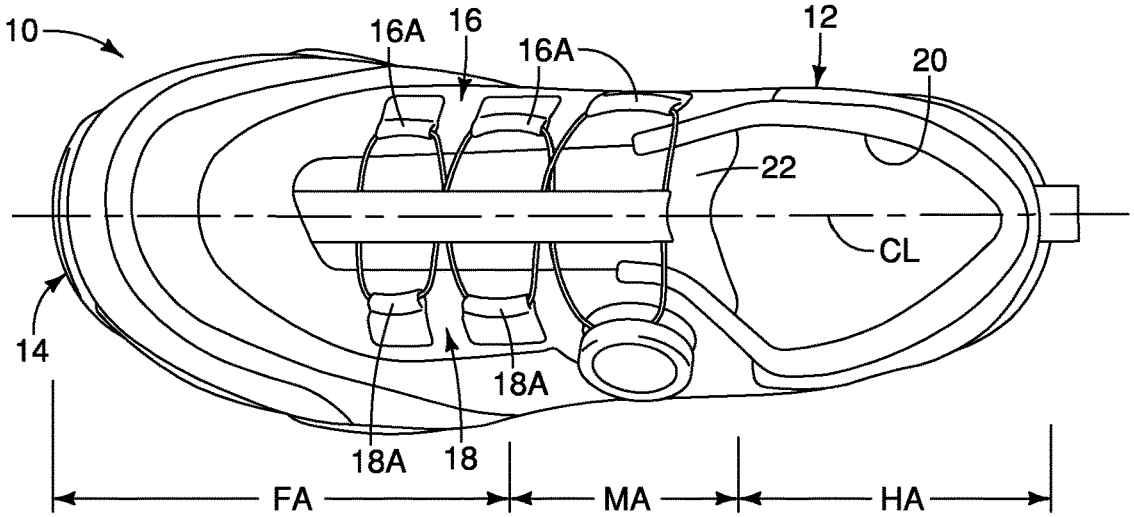
FIG. 2 is a top plan view of the shoe illustrated in FIG. 1.
Figure 3:
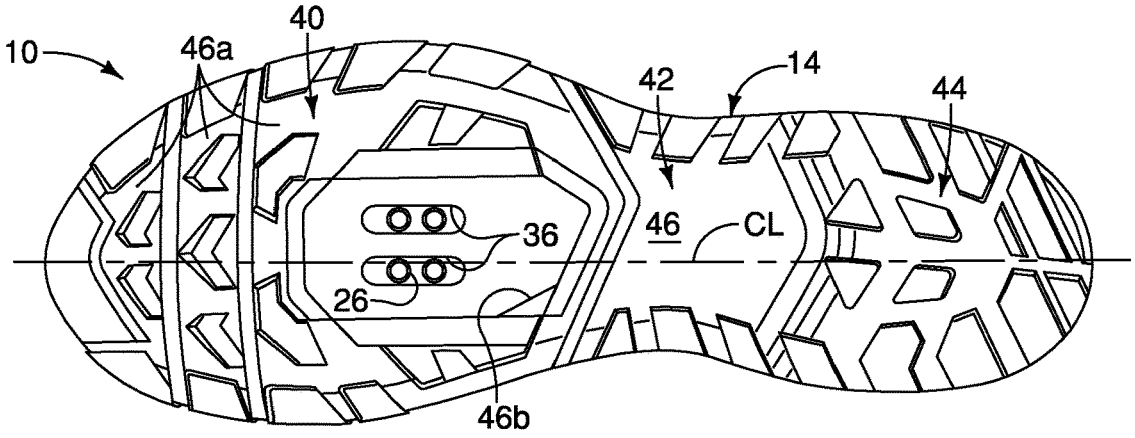
FIG. 3 is a bottom plan view of the shoe illustrated in FIG. 1.

Referring initially to FIGS. 1 to 3, a shoe 10 is illustrated in accordance with one illustrative embodiment of the present disclosure. The shoe 10 is a left shoe of a pair of left-right symmetric ones, in which the right shoe is omitted. The right shoe is identical to the shoe 10 (the left shoe), except that the right shoe is a mirror image of the shoe 10 (the left shoe). Accordingly, description of the shoe 10 applies equally to the right shoe. Therefore, description will be provide for only one of the shoes (the left shoe 10). The shoe 10 is especially suitable for cycling, and is configured such that cleat can be attached to the shoe 10. Thus, the shoe 10 can be considered a cycling shoe.

It should be understood from the drawings and the description herein that the terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms "outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure.

Basically, the shoe 10 comprises an upper 12 and a sole 14. As shown in FIGS. 1 and 2, the shoe 10 has a fore area FA, an arch or mid area MA and a heel area HA. The fore area FA and the heel area HA are spaced apart in a longitudinal axis X of the shoe 10 that extends between the fore area FA and the heel area HA while the mid area MA is positioned between the fore area FA and the heel area HA along the longitudinal axis X. The fore area FA of the shoe 10 receives a toe portion of a wearer's foot where the shoe 10 is on the wearer's foot. The mid area MA of the shoe 10 receives an arch portion of the wearer's foot where the shoe 10 is on the wearer's foot. The heel area HA of the shoe 10 receives a heel portion of the wearer's foot where the shoe 10 is on the wearer's foot.

Here, the upper 12 is a low-cut style of upper. However, the upper 12 is not limited to the low-cut style, but may be of any style. The upper 12 is made of any suitable natural or polymetric materials. The upper 12 can be formed of an expandable material or a non-expandable material. For example, the upper 12 can be made of a leather material, a nylon mesh and/or any other material that is utilized for conventional uppers.

As seen in FIG. 2, the upper 12 includes a first lateral side 16, a second lateral side 18 and an opening 20 between the first lateral side 16 and the second lateral side 18. The upper 12 further includes a tongue 22 between the first lateral side 16 and the second lateral side 18. The upper 12 further includes a closure 24 as a fastening structure for securing the shoe 10 to wearer's foot. The closure 24 includes at least one strap tightener 24A and at least one shoe strap 24B extending between the first lateral side 16 and the second lateral side 18. Here, the shoe strap 24B is a lace that is looped in eyelets 16A of the first lateral side 16 and that is looped in eyelets 18A of the second lateral side 18.

Alternatively, the upper 12 can include one or more fixing straps having a hook and loop fastener attachment with fabric hook and loop fastening materials. These fastening structures for securing shoes to wearer's feet are conventionally well-known structures. Thus, detail description of the fastening structures are omitted for the sake of brevity. The various portions of the upper 12 are stitched or otherwise fixed to one another. Since the present disclosure is applicable to a variety of differing shoe styles, designs and configuration, the depicted embodiment shows a basic shoe design that is made of several textile based materials that are sewn or stitched together to form the depicted shape. However, the present disclosure is not limited to the depicted shape, as will be understood from the description of the present disclosure below.

The sole 14 supports the upper 12. Specifically, the sole 14 is attached to the upper 12. The sole 14 can be fixedly attached to the upper 12 in a conventional manner, such as with stitching, adhesives, and/or embedding portions the upper 12 within the sole 14. Thus, the upper 12 and the sole 14 are integrated together. In the illustrated embodiment, the sole 14 is configured as an off-road or MTB sole. Here, as seen in FIG. 3, the shoe 10 further includes a cleat attachment 26 that is provided to the sole 14 for attaching a cleat.

Figure 4:
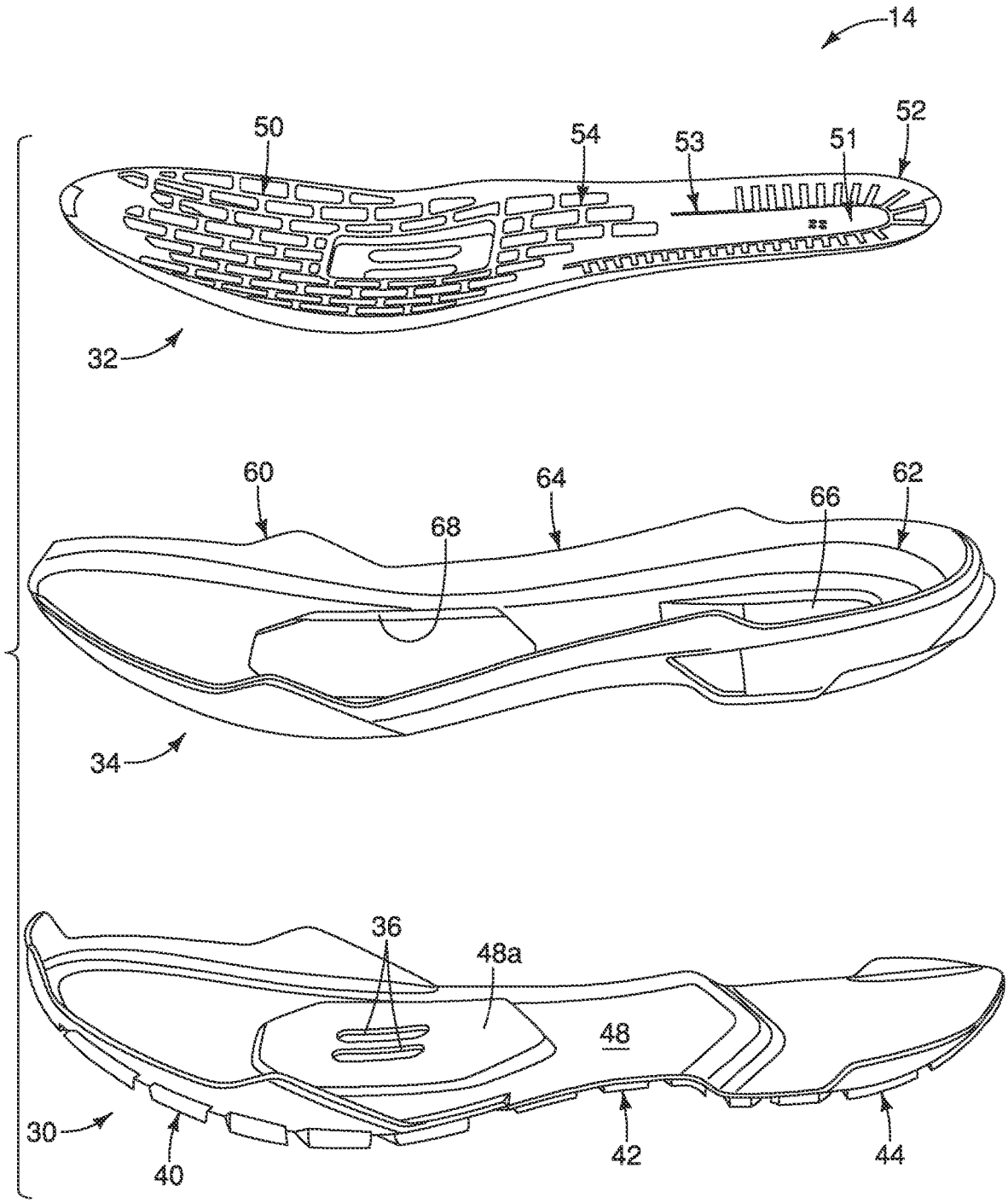
FIG. 4 is an exploded top perspective view of the sole (e.g., an outsole, a first midsole and a second midsole) of the shoe illustrated in FIGS. 1 and 2 as viewed from an outer side of the sole.
Figure 5:
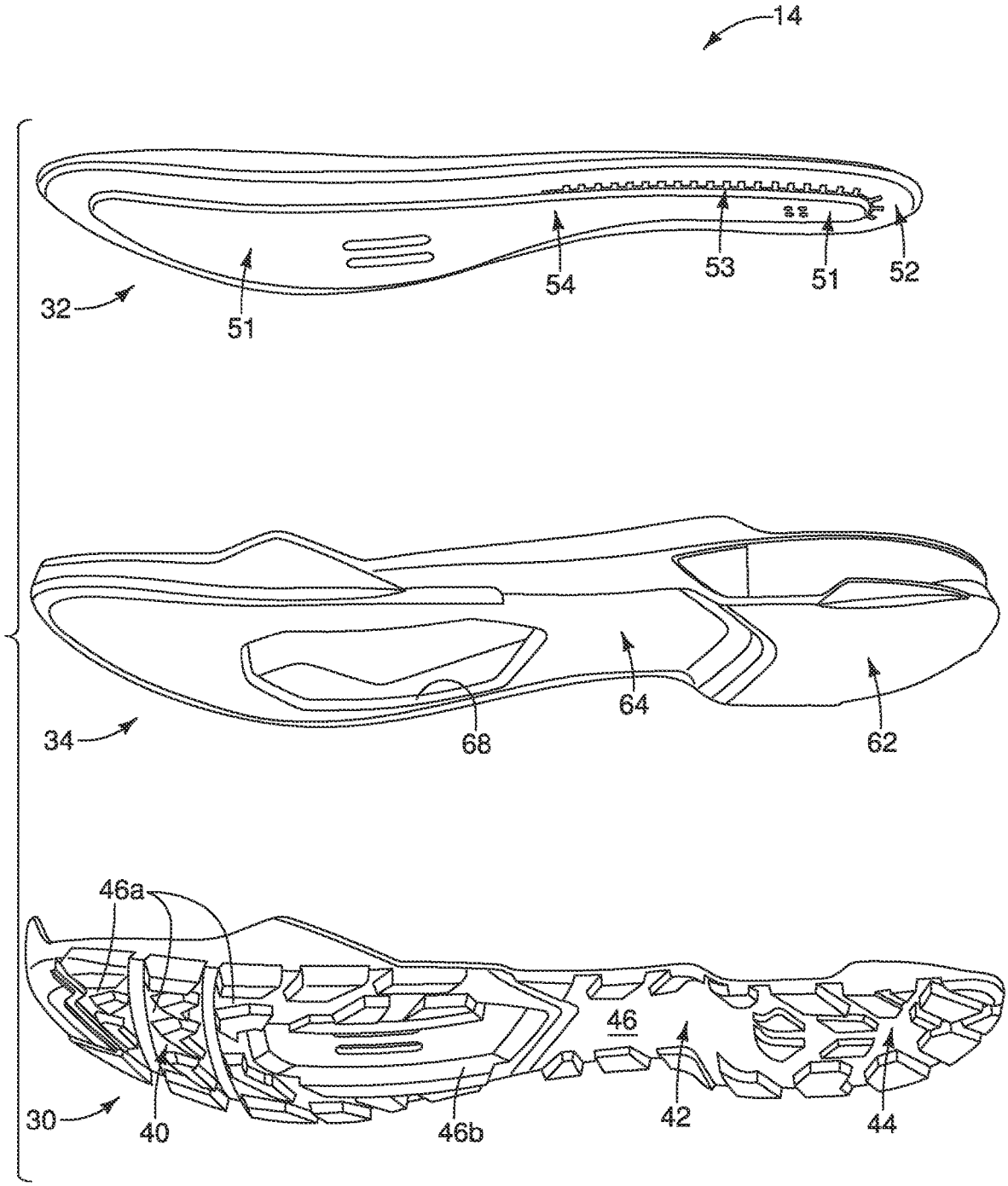
FIG. 5 is an exploded bottom perspective view of the sole (e.g., the outsole, the first midsole and the second midsole) illustrated in FIG. 4 for the shoe illustrated in FIGS. 1 and 2 as viewed from the outer side of the sole.
Figure 6:
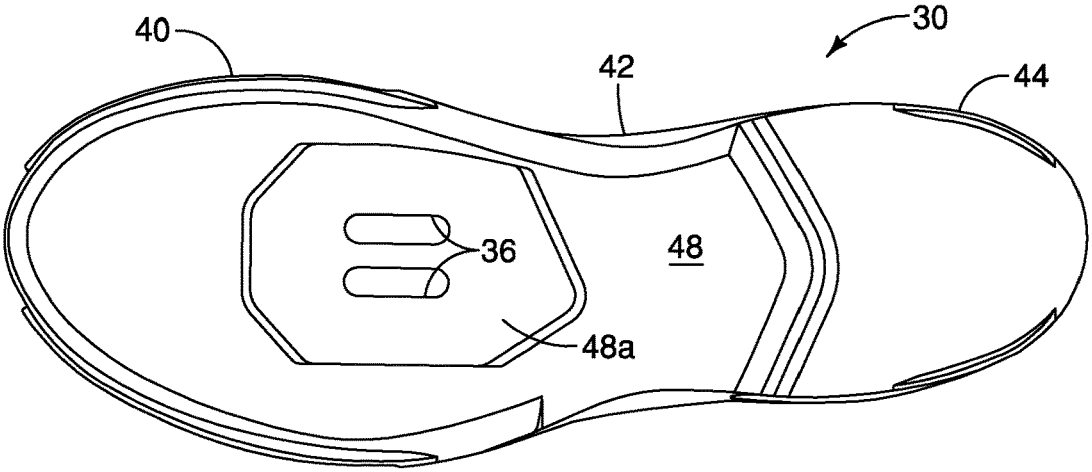
FIG. 6 is a top plan view of the outsole of the shoe illustrated in FIGS. 1 and 2.

As seen in FIGS. 4 and 5, the sole 14 includes an outsole 30 and a first midsole 32. In the illustrated embodiment, the shoe 10 further comprises a second midsole 34. The second midsole 34 is disposed between the outsole 30 and a first midsole 32. In particular, the second midsole 34 overlies the outsole 30, and the first midsole 32 overlies the second midsole 34. The outsole 30 is provided with a pair of slots 36 for a portion of the receiving the cleat attachment 26 (see FIG. 3). The outsole 30 is a one-piece member made of, for example, an elastic polymer material such as synthetic rubber or polyurethane (e.g., a thermoplastic polyurethane). The outsole 30 can be formed by injection molding.

As seen in FIGS. 3 to 6, the outsole 30 has an outer shape formed in a foot shape. The outsole 30 is a single piece of material that has a fore part 40, a mid part 42 and a heel part 44. The outsole 30 has a bottom surface 46 and a top surface 48. The bottom surface 46 forms the bottom surface of the shoe 10. The bottom surface 46 of the outsole 30 includes a plurality of grooves 46*a* that define the thread of the shoe 10. Further, the bottom surface 46 of the outsole 30 includes a recess 46*b*. The recess 46*b* is primarily located in the fore part 40 of the outsole 30. The slots 36 are located in the recess 46*b*. The recess 46*b* is sized to receive a cleat that is configured to engage a clipless pedal (i.e., a step-in type pedal). In this way, the cleat does not contact the ground while walking. The mid part 42 has a protrusion 48*a* projecting upward from the top surface 48 of the outsole 30. The protrusion 48*a* is aligned with the recess 46*b*. Thus, the slots 36 are located in the protrusion 48*a*.

As seen in FIGS. 7 to 10, the first midsole 32 has an outer shape formed in a foot shape. The outer shape of the first midsole 32 is slightly smaller than the outer shape of the outsole 30. However, the first midsole 32 does not need to be foot shaped and/or cover most of the outsole 30. The first midsole 32 at least overlies from the mid part 42 of the outsole 30 to the heel part 44 of the outsole 30. The first midsole 32 has a fore part 50, a first heel part 51 and a second heel part 52. The first midsole 32 has a boundary part 53. The first heel part 51 is connected to the fore part 50. Also, the second heel part 52 is connected to the fore part 50. In particular, the first midsole 32 has a mid part 54 that interconnects the first heel part 51 is connected to the fore part 50, and interconnects the second heel part 52 is connected to the fore part 50. The first midsole 32 is a one-piece member made of, for example, a fiber (e.g., carbon fibers, glass fibers, etc.) reinforced plastic (FRP). The fore part 50 of the first midsole 32 is provided with a pair of slots 56 for a portion of the receiving the cleat attachment 26 (see FIG. 3). The slots 56 of the first midsole 32 are aligned with the slots 36 of the outsole 30.

The first heel part 51 is at least partly disposed along a longitudinal centerline CL of the shoe 10. The first heel part 51 configured to support a center part of a heel. The second heel part 52 is disposed laterally outward of the longitudinal centerline CL of the shoe 10 and configured to support an outer part of the heel. The boundary part 53 is provided between the first heel part 51 and the second heel part 52 such that the first heel part 51 and the second heel part 52 are movable relative to one another.

In the first embodiment, the boundary part 53 includes at least one opening that is disposed between the first heel part 51 and the second heel part 52. In particular, the boundary part 53 includes a slit 58*a* that is disposed between the first heel part 51 and the second heel part 52. In other words, in the first embodiment, the at least one opening includes the slit 58*a*. While the slit 58*a* (i.e., the at least one opening) is illustrated as a single continuous slit, it will be apparent from this disclosure that the at least one opening can be formed of a plurality of slits or a plurality of opening having one or more shapes. Here, the slit 58*a* includes an elongated slot that extends generally parallel to the outline or peripheral edge of the first heel part 51 and a portion of the mid part 54, Also, here, the slit 58*a* includes a plurality of notches that extend from the elongated slot of the slit 58*a* towards the outline or peripheral edge of the first midsole 32. The boundary part 53 also includes a plurality of recesses 58*b* that extend from the slit 58*a* towards the outline or peripheral edge of the first midsole 32. The slit 58*a* and the recesses 58*b* reduces the rigidity of the boundary part 53 of the first midsole 32 as compared to the first heel part 51 and the second heel part 52. In any case, the boundary part 53 has a lower rigidity than the first heel part 51 and the second heel part 52.

Figure 7:
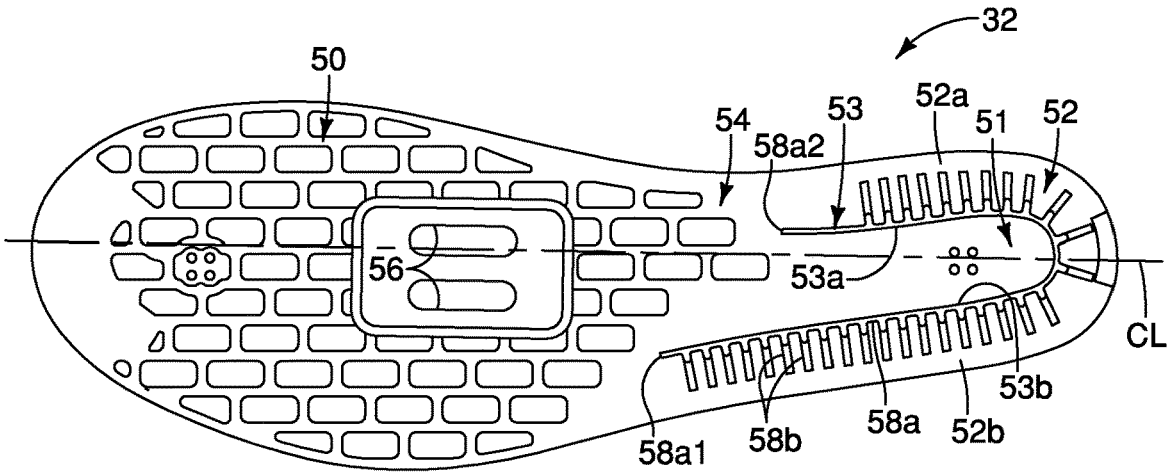
FIG. 7 is a top plan view of the first midsole of the shoe illustrated in FIGS. 1 and 2.
Figure 8:
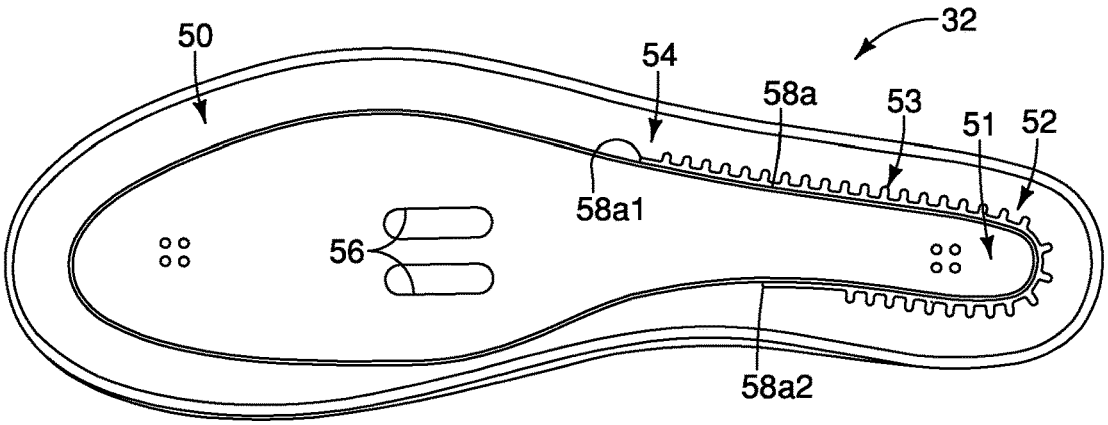
FIG. 8 is an outer side elevational view of the first midsole illustrated in FIG. 7.
Figure 9:
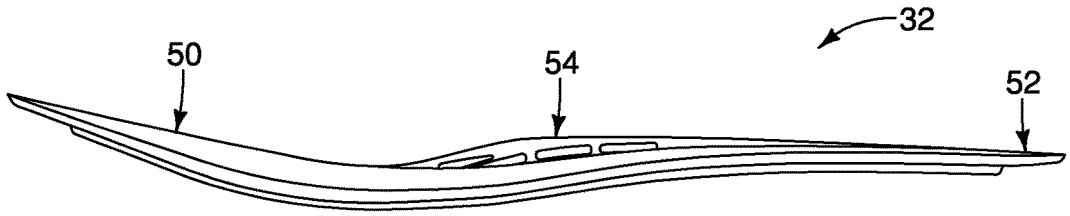
FIG. 9 is a bottom plan view of the first midsole of the shoe illustrated in FIGS. 7 and 8.
Figure 10:
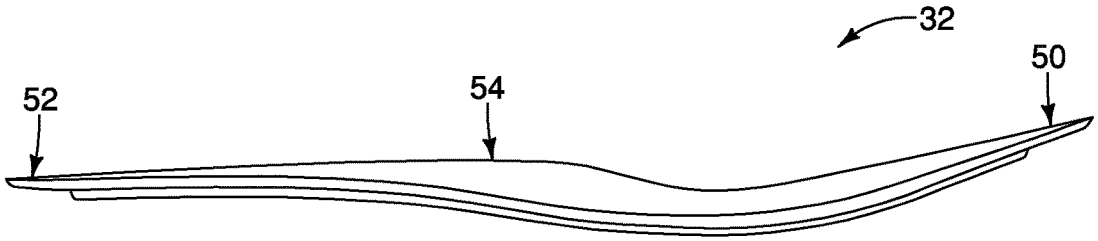
FIG. 10 is an inner side elevational view of the first midsole illustrated in FIGS. 7 to 9.

Here, the slit 58*a* has a first end 58*a*1 positioned on an outer lateral side of the first midsole 32 with respect to the longitudinal centerline CL and a second end 58*a*2 positioned on an inner lateral side of the first midsole 32 with respect to the longitudinal centerline CL. The first end 58*a*1 of the slit 58*a* is located in the mid part 54 such that the slit 58*a* on the outer lateral side of the first midsole 32 extends most or all of the longitudinal length of the mid part 54 of the first midsole 32. The second end 58*a*2 of the slit 58*a* is positioned rearward of the first end 58*a*1 or laterally aligned with respect to the longitudinal centerline CL. Here, as seen in FIG. 7, the second end 58*a*2 of the slit 58*a* is positioned rearward of the first end 58*a*1. The second end 58*a*2 of the slit 58*a* is located in the mid part 54 such that the slit 58*a* on the inner lateral side of the first midsole 32 extends less than half of the longitudinal length of the mid part 54 of the first midsole 32. If more flexibility of the second heel part 52 relative to the first heel part 51 is desired, the slit 58*a* can be lengthen on one or both of the outer lateral side and the inner lateral side. On the other hand, if less flexibility of the second heel part 52 relative to the first heel part 51 is desired, the slit 58*a* can be shorten on one or both of the outer lateral side and the inner lateral side.

The first heel part 51 is more rigid than the second heel part 52. Here, the first heel part 51 is a thicker than the second heel part 52 so that the second heel part 52 is less rigid than the first heel part 51. However, the rigidity of the second heel part 52 can be made less than the first heel part 51 in a variety of ways. For example, the second heel part 52 can be provided with localized areas of reduced thickness relative to the first heel part 51. Also, the second heel part 52 can be provided with openings in various locations. Alternatively, the first heel part 51 can be provided with reinforcements od other stiffing elements. In addition, if the first midsole 32 is made on two or more materials, then the material of the second heel part 52 can be less rigid than the material of the first heel part 51.

As seen in FIG. 7, the second heel part 52 includes an inside heel part 52*a* and an outside heel part 52*b*. The inside heel part 52*a* is the portion of the second heel part 52 that is located on the inner side of the longitudinal centerline CL. The outside heel part 52*b* is the portion of the second heel part 52 that is located on the outer side of the longitudinal centerline CL. The boundary part 53 includes an inside boundary part 53*a* and an outside boundary part 53*b*. The inside boundary part 53*a* is the portion of the boundary part 53 that is located on the inner side of the longitudinal centerline CL. The outside boundary part 53*b* is the portion of the boundary part 53 that is located on the outer side of the longitudinal centerline CL. The inside boundary part 53*a* is positioned between the inside heel part and the first heel part 51. The outside boundary part 53 is positioned between the outside heel part 52*b* and the first heel part 51.

As seen in FIGS. 11 to 15, the second midsole 34 has an outer shape formed in a foot shape. The outer shape of the second midsole 34 is slightly smaller than the outer shape of the outsole 30, and slightly larger than the outer shape of the first midsole 32. The second midsole 34 has a fore part 60, a heel part 62 and a mid part 64. The second midsole 34 is a one-piece member made of, for example, an ethylene-vinyl acetate (EVA) copolymer, or a urethane.

Figure 11:
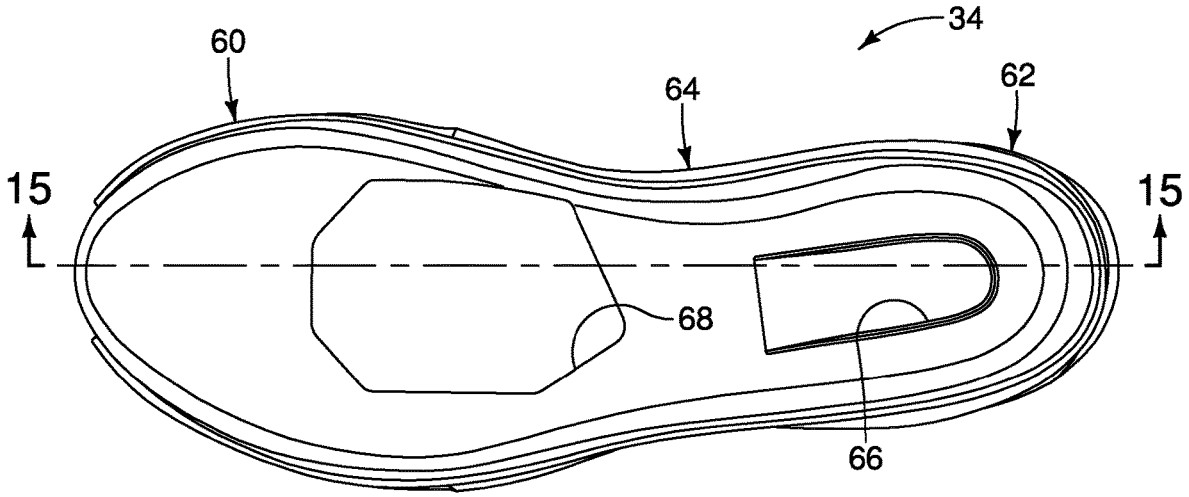
FIG. 11 is a top plan view of the second midsole of the shoe illustrated in FIGS. 1 and 2.
Figure 12:
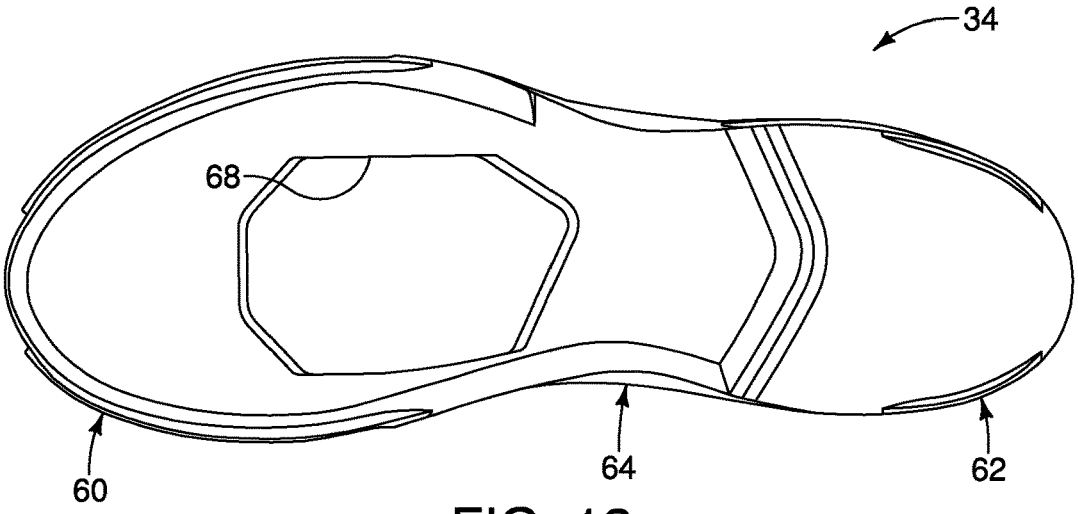
FIG. 12 is an outer side elevational view of the second midsole illustrated in FIG. 11.
Figure 13:
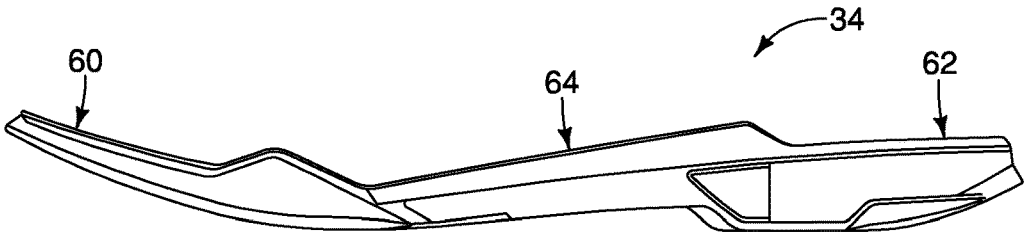
FIG. 13 is a bottom plan view of the second midsole of the shoe illustrated in FIGS. 11 and 12.
Figure 14:
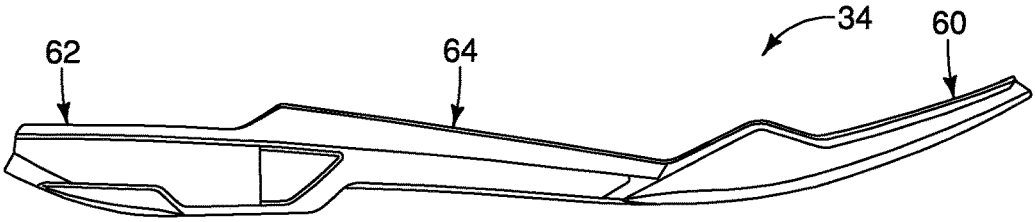
FIG. 14 is an inner side elevational view of the second midsole illustrated in FIGS. 11 to 13.
Figure 15:
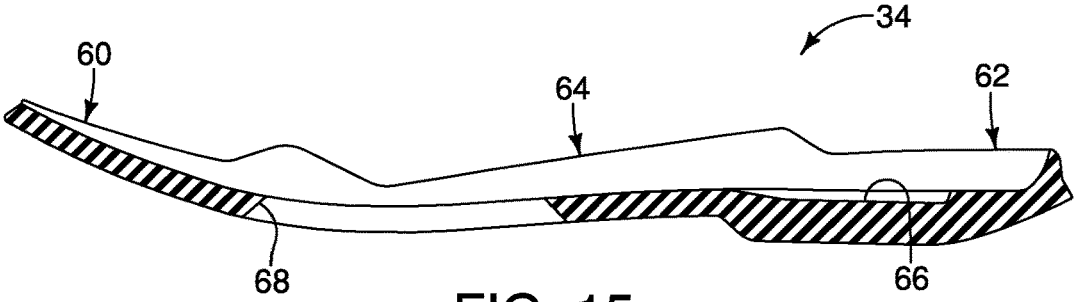
FIG. 15 is a longitudinal cross-sectional view of the second midsole illustrated in FIGS. 11 to 14 as viewed along section line 15-15 of FIG. 11.

As mentioned above, the second midsole 34 is disposed beneath the first midsole 32, and above the outsole 30. Thus, the second midsole 34 is disposed at least beneath the first heel part 51 of the first midsole 32. Here, as seen in FIGS. 11 and 15, the second midsole 34 has a receiving portion 66. The receiving portion 66 is primarily located in the heel part 62 to the second midsole 34. The receiving portion 66 is configured to receive at least a portion the first heel part 51 upon relative movement of the first heel part 51 towards the outsole 30. In other words, during walking, the first midsole 32 moves downward towards the second midsole 34 and the outsole 30. Due to the boundary part 53 allowing relative movement of the first heel part 51 relative to the second heel part 52, the first heel part 51 can be at least partly received in the receiving portion 66 of the second midsole 34. Thus, the receiving portion 66 aids in the relative movement of the first heel part 51 relative to the second heel part 52 such that the second heel part 52 can absorb the contact force from the ground during walking. Here, the receiving portion 66 includes a hollow depression.

As seen in FIGS. 11 and 15, the second midsole 34 further includes an opening 68 that is located primarily in the fore part 60 of the second midsole 34. The opening 68 is shaped to snugly receive the protrusion 48*a* of the outsole 30. Thus, with this arrangement, relative movement between the second midsole 34 and the outsole 30 is resisted.

Figure 16:
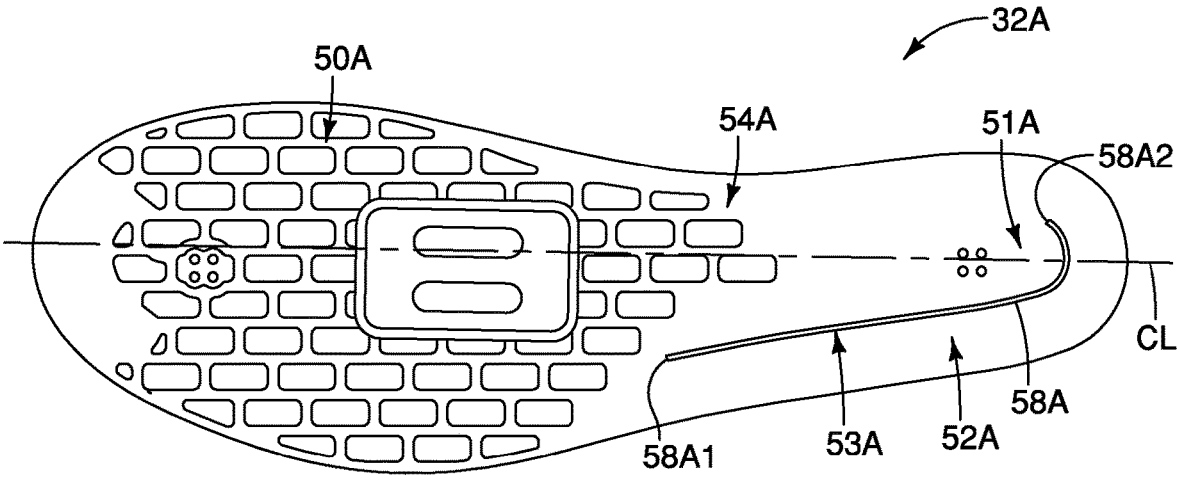
FIG. 16 is a top plan view of a first midsole in accordance with a first modification.

Referring now to FIG. 16, a first midsole 32A is illustrated in accordance with a first modification. The first midsole 32A is used instead of the first midsole 32 in the shoe 10. In view of the similarity between the first midsole 32 and the first midsole 32A, only the differences of the first midsole 32A will be discussed. Here, the first midsole 32A has a fore part 50A, a first heel part 51A, a second heel part 52A and a mid part 54A. The first midsole 32A further includes a boundary part 53A that separates the first heel part 51A from the second heel part 52A. The first midsole 32A is identical to the first midsole 32, except that the boundary part 53A of the first midsole 32A has been modified relative to the boundary part 53 of the first midsole 32. Here, the boundary part 53A is a slit 58A has a first end 58A1 positioned on an outer lateral side of the first midsole 32A with respect to the longitudinal centerline CL and a second end 58A2 positioned on an inner lateral side of the first midsole 32 with respect to the longitudinal centerline CL. The second end 58A2 of the slit 58A is positioned rearward of the first end 58A1 of the slit 58A.

Figure 17:
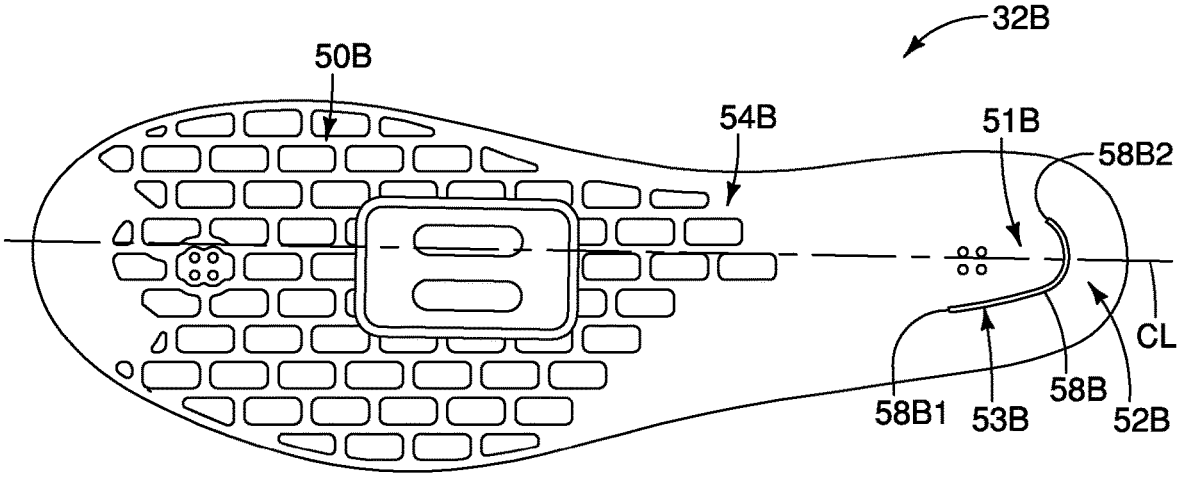
FIG. 17 is a top plan view of a first midsole in accordance with a second modification.

Referring now to FIG. 17, a first midsole 32B is illustrated in accordance with a second modification. The first midsole 32B is used instead of the first midsole 32 in the shoe 10. In view of the similarity between the first midsole 32 and the first midsole 32B, only the differences of the first midsole 32B will be discussed. Here, the first midsole 32B has a fore part 50B, a first heel part 51B, a second heel part 52B and a mid part 54B. The first midsole 32B further includes a boundary part 53B that separates the first heel part 51B from the second heel part 52B. The first midsole 32B is identical to the first midsole 32, except that the boundary part 53B of the first midsole 32B has been modified relative to the boundary part 53 of the first midsole 32. Here, the boundary part 53B is a slit 58B has a first end 58B1 positioned on an outer lateral side of the first midsole 32B with respect to the longitudinal centerline CL and a second end 58B2 positioned on an inner lateral side of the first midsole 32 with respect to the longitudinal centerline CL. The second end 58B2 of the slit 58B is positioned rearward of the first end 58B1 of the slit 58B.

Figure 18:
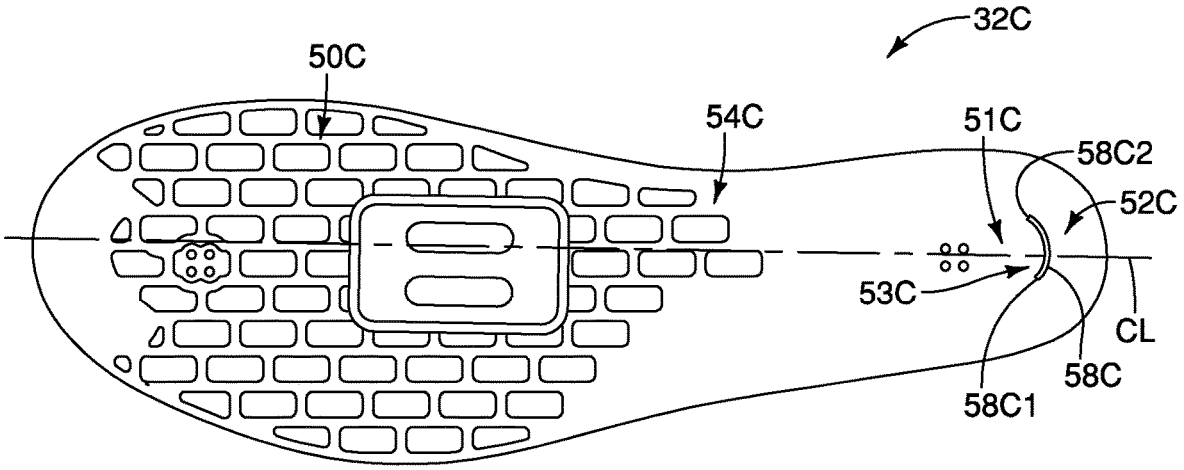
FIG. 18 is a top plan view of a first midsole in accordance with a third modification.

Referring now to FIG. 18, a first midsole 32C is illustrated in accordance with a third modification. The first midsole 32C is used instead of the first midsole 32 in the shoe 10. In view of the similarity between the first midsole 32 and the first midsole 32C, only the differences of the first midsole 32C will be discussed. Here, the first midsole 32C has a fore part 50C, a first heel part 51C, a second heel part 52C and a mid part 54C. The first midsole 32C further includes a boundary part 53C that separates the first heel part 51C from the second heel part 52C. Here, the boundary part 53C is a slit 58C has a first end 58C1 positioned on an outer lateral side of the first midsole 32C with respect to the longitudinal centerline CL and a second end 58C2 positioned on an inner lateral side of the first midsole 32 with respect to the longitudinal centerline CL. The second end 58C2 of the slit 58C is laterally aligned with the first end 58C1 with respect to the longitudinal centerline C.

Figure 19:
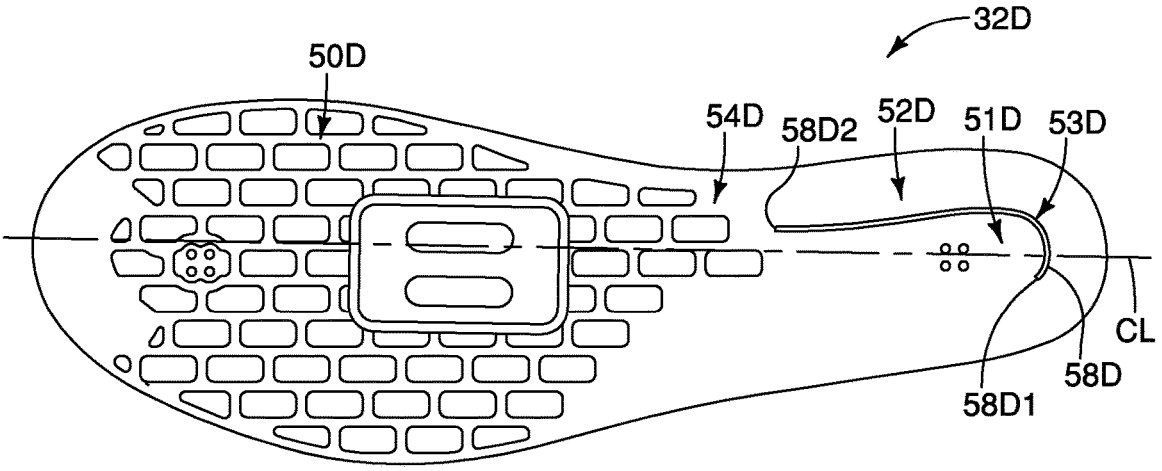
FIG. 19 is a top plan view of a first midsole in accordance with a fourth modification.

Referring now to FIG. 19, a first midsole 32D is illustrated in accordance with a fourth modification. The first midsole 32D is used instead of the first midsole 32 in the shoe 10. In view of the similarity between the first midsole 32 and the first midsole 32D, only the differences of the first midsole 32D will be discussed. Here, the first midsole 32D has a fore part 50D, a first heel part 51D, a second heel part 52D and a mid part 54D. The first midsole 32D further includes a boundary part 53D that separates the first heel part 51D from the second heel part 52D. The first midsole 32D is identical to the first midsole 32, except that the boundary part 53D of the first midsole 32D has been modified relative to the boundary part 53 of the first midsole 32. Here, the boundary part 53D is a slit 58D has a first end 58D1 positioned on an outer lateral side of the first midsole 32D with respect to the longitudinal centerline CL and a second end 58D2 positioned on an inner lateral side of the first midsole 32 with respect to the longitudinal centerline CL. The first end 58D1 of the slit 58D is positioned rearward of the second end 58D2 of the slit 58D.

Figure 20:
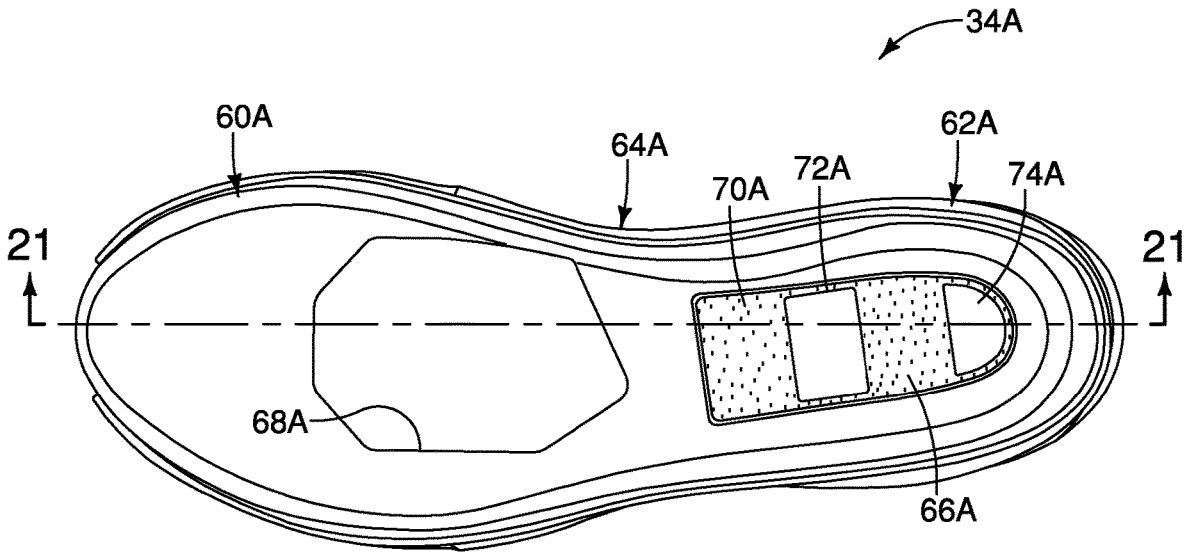
FIG. 20 is a top plan view of the second midsole in accordance with a first modification.
Figure 21:
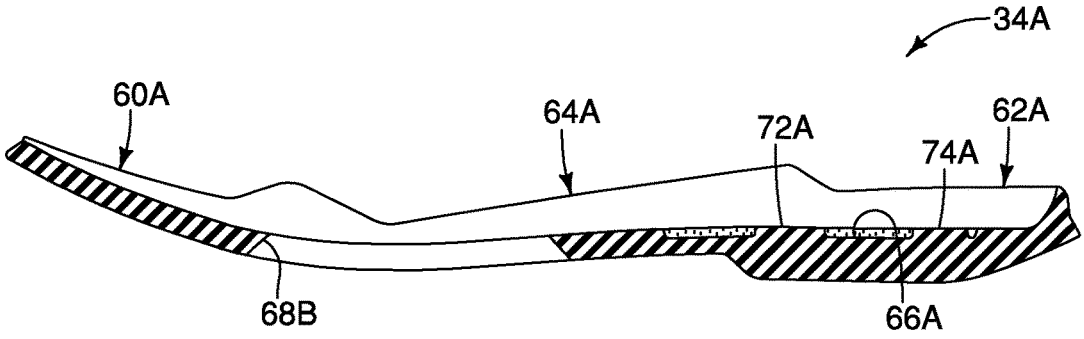
FIG. 21 is a longitudinal cross sectional view of the second midsole illustrated in FIG. 20 as viewed along section line 21-21 of FIG. 20.

Referring now to FIGS. 20 and 21, a second midsole 34A is illustrated in accordance with a first modification. The second midsole 34A is used instead of the second midsole 34 in the shoe 10. In view of the similarity between the second midsole 34 and the second midsole 34A, only the differences of the second midsole 34A will be discussed. Here, the second midsole 34A has a fore part 60A, a heel part 62A and a mid part 64A. Here, the heel part 62A of the second midsole 34A includes a receiving portion 66A. The fore part 60A of the second midsole 34A includes an opening 68A The second midsole 34A is identical to the second midsole 34, except that the receiving portion 66A of the second midsole 34A has been modified relative to the receiving portion 66 of the second midsole 34. Here, the receiving portion 66 includes a foam material 70A having a hardness that is lower than a surrounding portion of the second midsole 34 that at least partly surrounds the receiving portion 66. The force to cause the relative movement of the first heel part 51 into the receiving portion 66A can be easily regulated based on the hardness of the foam material 70A that is used and/or or the shape of the recessed portion of the receiving portion 66A. Here, the first modification, the receiving portion 66A is provided with a pair of protrusions 72A and 74A. Optionally, the protrusions 72A and 74A can be omitted and the receiving portion 66A can just be a single recess that is filled with the foam material 70A.

Figure 22:
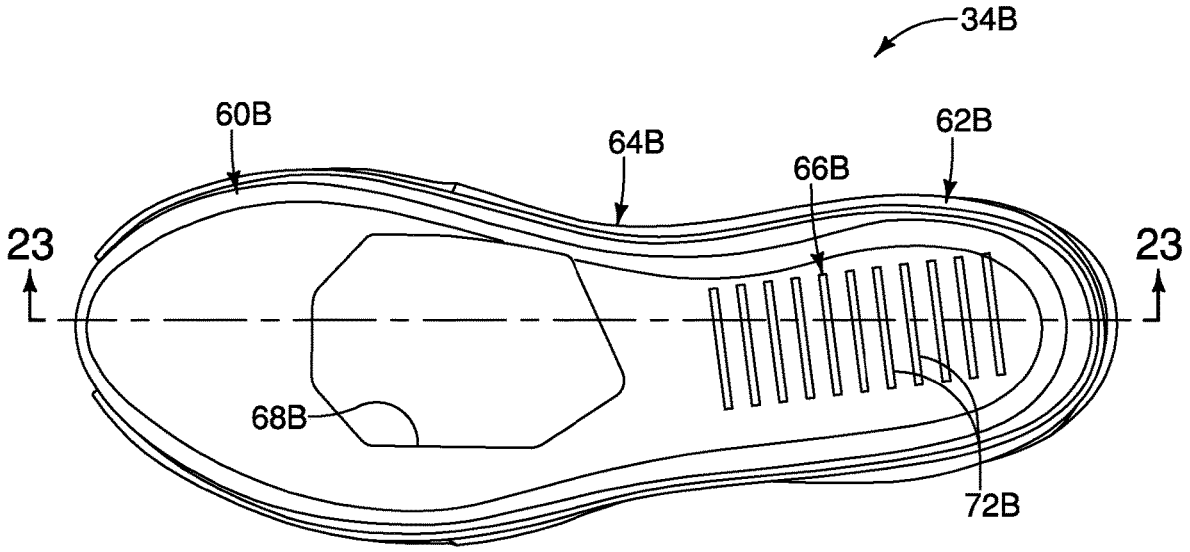
FIG. 22 is a top plan view of the second midsole in accordance with a second modification.
Figure 23:
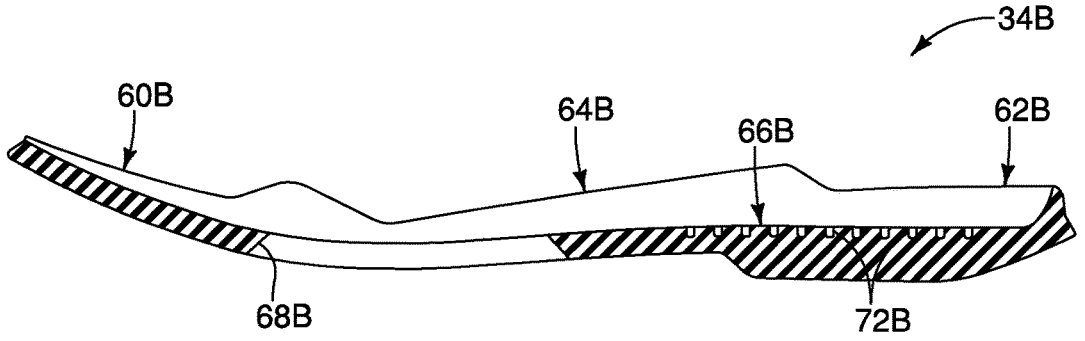
FIG. 23 is a longitudinal cross sectional view of the second midsole illustrated in FIG. 20 as viewed along section line 23-23 of FIG. 20.

Referring now to FIGS. 22 and 23, a second midsole 34B is illustrated in accordance with a second modification. The second midsole 34B is used instead of the second midsole 34 in the shoe 10. In view of the similarity between the second midsole 34 and the second midsole 34B, only the differences of the second midsole 34B will be discussed. Here, the second midsole 34B has a fore part 60B, a heel part 62B and a mid part 64B. Here, the heel part 62B of the second midsole 34B includes a receiving portion 66B. The fore part 60B of the second midsole 34B includes an opening 68B.

The second midsole 34B is identical to the second midsole 34, except that the receiving portion 66B of the second midsole 34B has been modified relative to the receiving portion 66 of the second midsole 34. Here, the receiving portion 66B includes a plurality of slits 72B. The force to cause the relative movement of the first heel part 51 into the receiving portion 66B regulated based on the number and/or size of the slits 72B. Optionally, the slits 72B can be filled with a foam material.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A shoe comprising:

an upper; and a sole attached to the upper, the sole including an outsole and a first midsole, the first midsole having a fore part, a first heel part at least partly disposed along a longitudinal centerline of the shoe and configured to support a center part of a heel, a second heel part disposed laterally outward of the longitudinal centerline of the shoe and configured to support an outer part of the heel, and a boundary part includes a slit disposed between the first heel part and the second heel part such that the first heel part and the second heel part are movable relative to one another, the second heel part extending from the boundary part towards a peripheral edge of the sole as a planar surface, the boundary part having a first end and a second end, the first end extending closer to the fore part than the second end extends to the fore part.

2. The shoe according to claim 1, wherein the boundary part includes at least one opening disposed between the first heel part and the second heel part.

3. The shoe according to claim 1, wherein the boundary part has a lower rigidity than the first heel part and the second heel part.

4. The shoe according to claim 3, wherein the slit has a first end positioned on an outer lateral side of the first midsole with respect to the longitudinal centerline and a second end positioned on an inner lateral side of the first midsole with respect to the longitudinal centerline, the second end of the slit is positioned rearward of the first end or laterally aligned with respect to the longitudinal centerline.

5. The shoe according to claim 1, wherein the second heel part includes an inside heel part and an outside heel part, and the boundary part includes an inside boundary part positioned between the inside heel part and the first heel part, and an outside boundary part positioned between the outside heel part and the first heel part.

6. The shoe according to claim 1, further comprising a second midsole at least disposed beneath the first heel part of the first midsole, the second midsole having a receiving portion configured to receive at least a portion the first heel part upon relative movement of the first heel part towards the outsole.

7. The shoe according to claim 6, wherein the receiving portion includes a hollow depression.

8. The shoe according to claim 6, wherein the receiving portion includes a plurality of slits.

9. The shoe according to claim 6, wherein the receiving portion includes a foam material having a hardness that is lower than a surrounding portion of the second midsole that at least partly surrounds the receiving portion.

10. The shoe according to claim 1, wherein the slit extends partway through the second heel part and is spaced from the peripheral edge of the sole.

11. A shoe comprising:

an upper; and a sole attached to the upper, the sole including an outsole and a first midsole, the first midsole at least overlying from a mid part of the outsole to a heel part of the outsole, the first midsole having a fore part, a first heel part connected to the fore part, and a second heel part connected to the fore part, and a boundary part includes a slit disposed between the first heel part and the second heel part, the boundary part having a first end and a second end, the first end extending closer to the fore part than the second end extends to the fore part, the first heel part being more rigid than the second heel part, the second heel part extending from the boundary part towards a peripheral edge of the sole as a planar surface.

12. The shoe according to claim 11, further comprising a second midsole at least disposed beneath the first heel part of the first midsole, the second midsole having a receiving portion configured to receive at least a portion the first heel part upon relative movement of the first heel part towards the outsole.

13. The shoe according to claim 12, wherein the receiving portion includes a hollow depression.

14. The shoe according to claim 12, wherein the receiving portion includes a plurality of slits.

15. The shoe according to claim 12, wherein the receiving portion includes a foam material having a hardness that is lower than a surrounding portion of the second midsole that at least partly surrounds the receiving portion.

16. The plurality of shoe according to claim 14, wherein the slits extend partway through the second heel part and is spaced from the peripheral edge of the sole.

* * * * *